US010897949B1

(12) United States Patent
Hakopyan

(10) Patent No.: US 10,897,949 B1
(45) Date of Patent: Jan. 26, 2021

(54) ILLUMINATING-SHOE ATTACHMENT

(71) Applicant: Oganes Hakopyan, Woodland Hills, CA (US)

(72) Inventor: Oganes Hakopyan, Woodland Hills, CA (US)

( * ) Notice: Subject to any disclaimer, the term of this patent is extended or adjusted under 35 U.S.C. 154(b) by 0 days.

(21) Appl. No.: 15/912,708

(22) Filed: Mar. 6, 2018

(51) Int. Cl.
*A43B 3/00* (2006.01)
*F21V 21/08* (2006.01)
*A43C 19/00* (2006.01)

(52) U.S. Cl.
CPC ..... *A43B 3/001* (2013.01); *A43C 19/00* (2013.01)

(58) Field of Classification Search
CPC ..... A43B 3/0021; A43B 3/001; A43C 19/00
See application file for complete search history.

(56) References Cited

U.S. PATENT DOCUMENTS 5,438,488 A * 8/1995 Dion ..... A43B 1/0072 2/245
5,465,197 A * 11/1995 Chien ..... A43B 1/0036 200/61.51
5,746,500 A * 5/1998 Chien ..... A43B 1/0036 36/137
5,866,987 A * 2/1999 Wut ..... A43B 1/0036 315/119
5,894,686 A * 4/1999 Parker ..... A43B 3/0021 36/137
5,934,784 A * 8/1999 Dion ..... A43B 1/0036 362/103
6,278,378 B1 * 8/2001 Feiner ..... A43B 1/0036 340/573.1
6,788,201 B2 * 9/2004 Chen ..... A43B 3/0005 200/61.45 M
7,695,154 B2 * 4/2010 Ellenburg ..... A43B 1/0036 362/103
D617,925 S 6/2010 Coushaine
8,444,284 B2 5/2013 Malone
8,632,215 B2 * 1/2014 Catalano ..... F21K 9/238 362/246
2004/0085216 A1 * 5/2004 Chen ..... A43B 3/0005 340/686.1
2009/0091922 A1 * 4/2009 Yang ..... A43B 1/0036 362/103
2009/0267537 A1 * 10/2009 Rubinstin ..... A43B 3/0005 315/297
2015/0272262 A1 10/2015 Escamilla
2017/0016604 A1 7/2017 Gou

FOREIGN PATENT DOCUMENTS

EP 0534560 A 3/1993

* cited by examiner

*Primary Examiner* — Jila M Mohandesi

(57) ABSTRACT

The illuminating-shoe attachment is a device that attaches to the front of a shoe using straps to hold onto the shoe's laces. A plurality of LEDs within the illuminating-shoe attachment are powered by one or more batteries within the device to provide illumination in front of the shoe. The illumination may assist in walking after dark—as a non-limiting example the illumination may be all white or all red light. Alternatively, the illumination may be multi-color and may change in random or predetermined patterns for entertainment value. The device may comprise a timer to start or stop illuminating the LEDs based upon a timed interval and a motion sensor to start or stop illumination based upon movement. The device may comprise a sound transducer to produce a variety of sounds while the LEDs are illuminated.

10 Claims, 5 Drawing Sheets

ILLUMINATING-SHOE ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of recreational and entertainment lighting, more specifically, a illuminating-shoe attachment.

SUMMARY OF INVENTION

The illuminating-shoe attachment is a device that attaches to the front of a shoe using straps to hold onto the shoe's laces. A plurality of LEDs within the illuminating-shoe attachment are powered by one or more batteries within the device to provide illumination in front of the shoe. The illumination may assist in walking after dark—as a non-limiting example the illumination may be all white or all red light. Alternatively, the illumination may be multi-color and may change in random or predetermined patterns for entertainment value. The device may comprise a timer to start or stop illuminating the LEDs based upon a timed interval and a motion sensor to start or stop illumination based upon movement. The device may comprise a sound transducer to produce a variety of sounds while the LEDs are illuminated.

An object of the invention is to provide illumination in the front of a shoe.

Another object of the invention is to provide illumination that is activated by a movement of the device.

A further object of the invention is to provide illumination that is activated or deactivated based upon a timed interval.

Yet another object of the invention is to provide sound while the LEDs are illuminated.

These together with additional objects, features and advantages of the illuminating-shoe attachment will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminating-shoe attachment in detail, it is to be understood that the illuminating-shoe attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminating-shoe attachment.

It is therefore important that the claims be regarded as including such equivalent construction insofar as they do not depart from the spirit and scope of the illuminating-shoe attachment. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
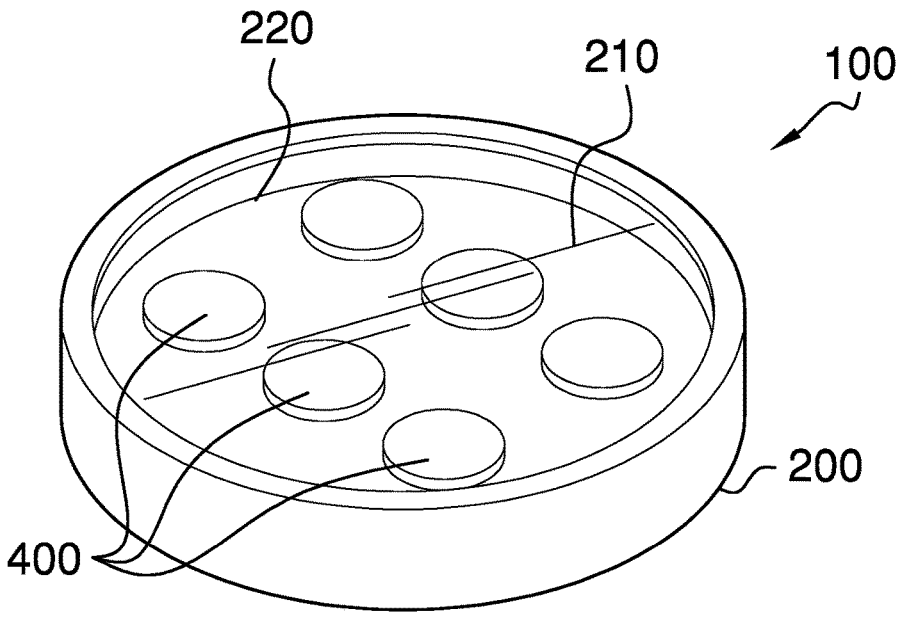
FIG. 1 is a perspective view of an embodiment of the disclosure.
Figure 2:
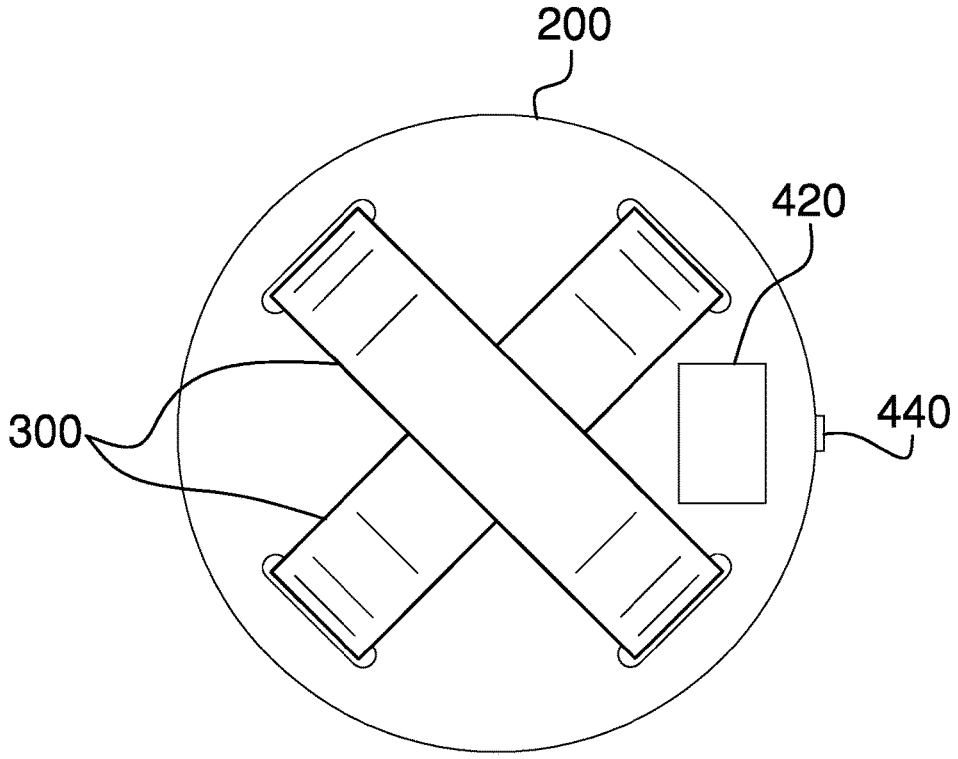
FIG. 2 is a bottom view of an embodiment of the disclosure.
Figure 3:
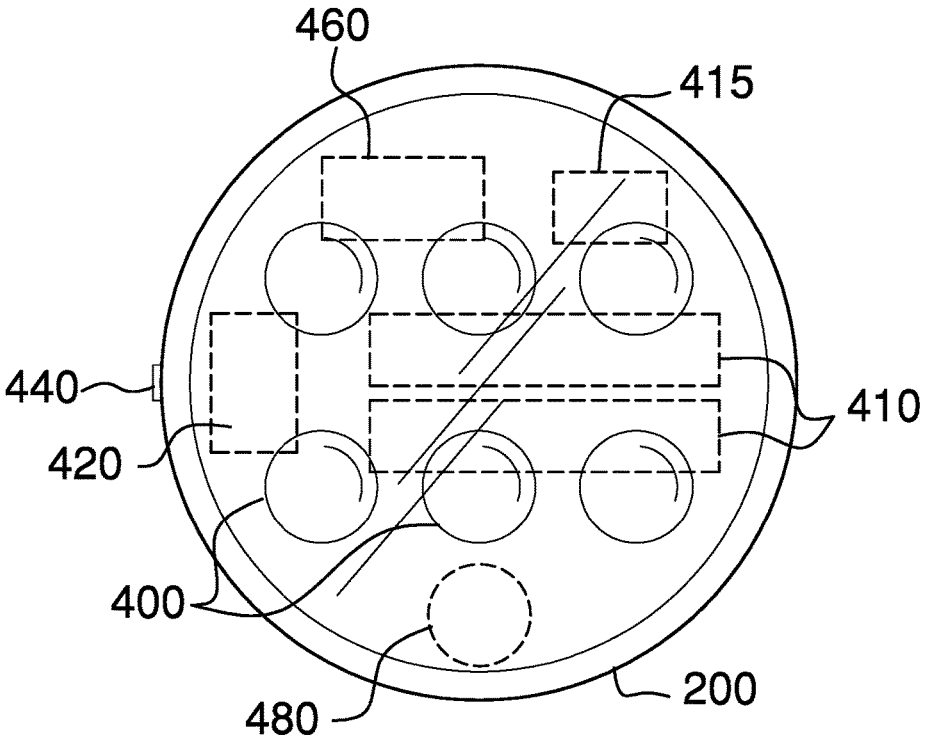
FIG. 3 is a top view of an embodiment of the disclosure.
Figure 4:
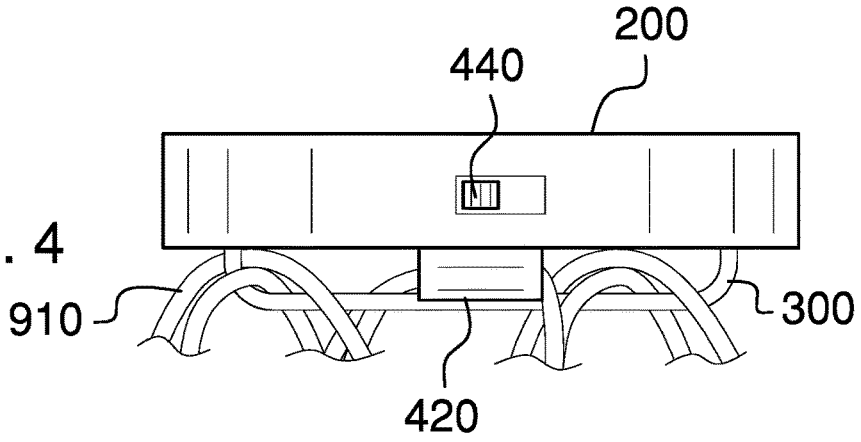
FIG. 4 is a side view of an embodiment of the disclosure.
Figure 5:
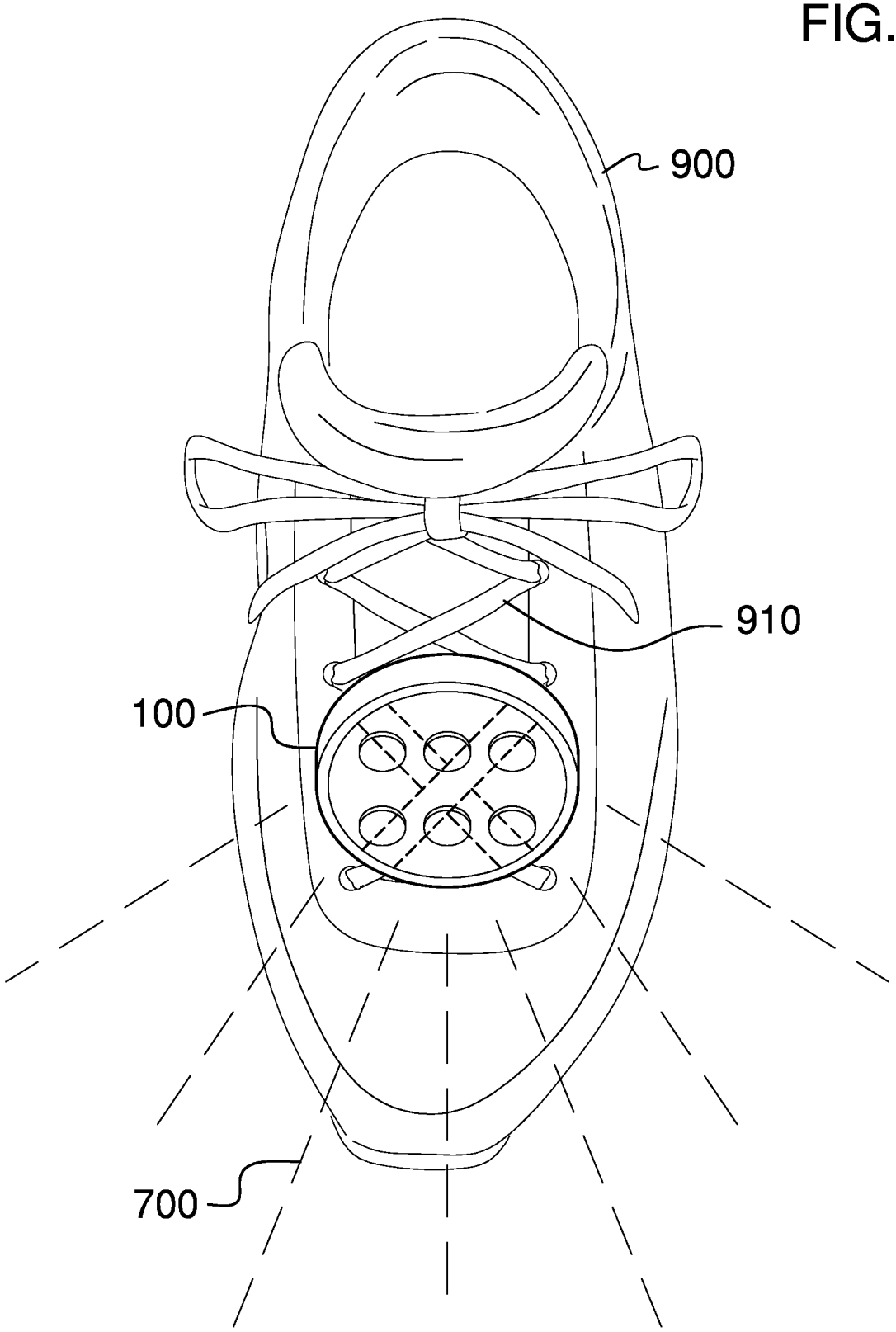
FIG. 5 is an in-use view of an embodiment of the disclosure.
Figure 6:
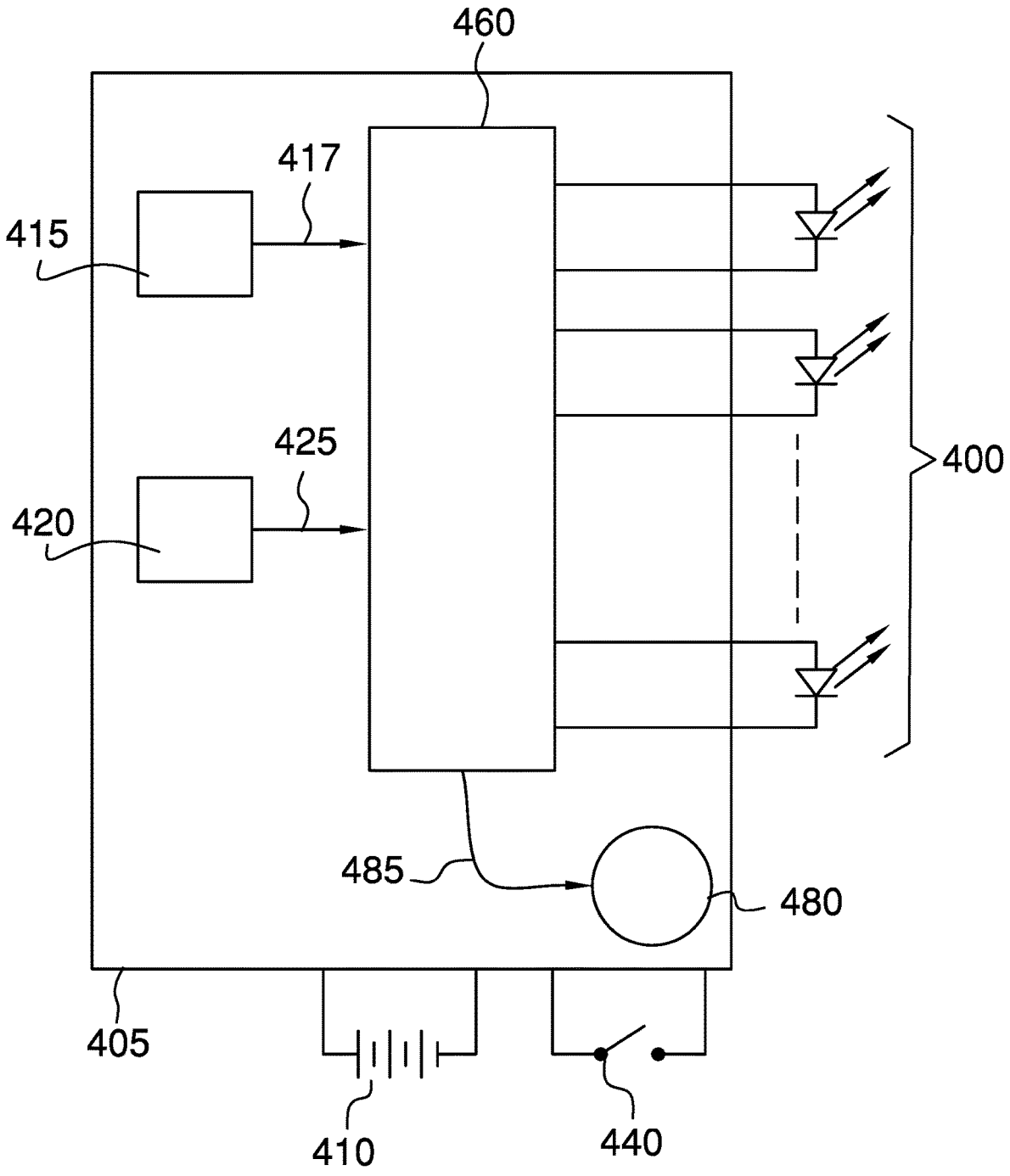
FIG. 6 is a schematic diagram of an embodiment of the disclosure.
Figure 7:
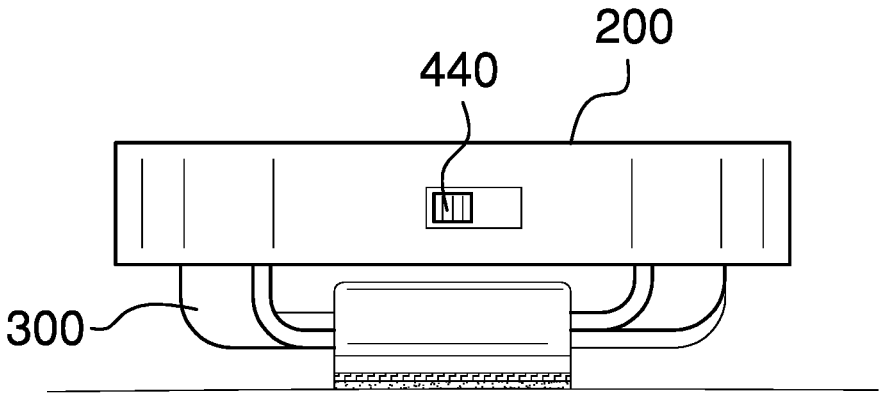
FIG. 7 is a side view of an alternative embodiment of the disclosure.

Detailed reference will now be made to a first potential embodiment of the disclosure, which is illustrated in FIGS. 1 through 7.

The illuminating-shoe attachment 100 (hereinafter invention) comprises a housing 200, a clear lens 210, one or more LEDs 400, one or more attachment straps 300, one or more batteries 410, an on/off control 440, and a circuit board 405. The invention 100 attaches to laces 910 of a shoe 900 and provides illumination 700 at the front of the shoe 900. The illumination 700 may improve visibility at night, may be decorative, or both.

The housing 200 may be an enclosure for the one or more LEDs 400, the one or more attachment straps 300, the one or more batteries 410, the on/off control 440, the circuit board 405, and the clear lens 210. The housing 200 may have a top and a bottom with the top being the surface facing away from the shoe 900 and the bottom being the surface facing towards the shoe 900.

In some embodiments, the housing 200 may be a plastic enclosure that is circular when seen from the top and that has a uniform thickness when viewed from any side. The clear lens 210 may be coupled to the top of the housing 200. The clear lens 210 may allow the illumination 700 from the one or more LEDs 400 to exit the housing 200 while protecting the invention 100 from water exposure. The one or more LEDs 400 may be located under the clear lens 210 on an inset surface 220 under the clear lens 210. In some embodiments, the inset surface 220 may be the circuit board 405 upon which the one or more LEDs 400 are mounted.

The one or more LEDs 400 may be light sources. The one or more LEDs 400 may all be the same color, may be a mixture of different colors, or may be multi-color LEDs. As non-limiting examples, all of the LEDs may be the same color, such as white, each LED may be a single color but not the same color as all other LEDs, such as one red LED, one green LED, one white LED, one yellow LED, one blue LED, and one orange LED, one or more of the LEDs may be multi-color LEDS where the color of an individual LED can be selected based upon the combination of connections, voltages, and currents used to activate the LED, or a combination thereof.

In some embodiments, the invention 100 may comprise control electronics 460 which change the brightness and/or color of the one or more LEDs 400 in a random pattern or in a predetermined pattern. The control electronics 460 may be coupled to the circuit board 405.

The one or more attachment straps 300 may be coupled to the bottom of the housing 200. The one or more attachment straps 300 may provide a physical interface for attaching the invention 100 to the shoe 900. Specifically, the laces 910 of the shoe 900 may be passed through the one or more attachment straps 300 to removably couple the invention 100 to the shoe 900. As a non-limiting example, the shoe 900 may be laced through the one or more attachment straps 300 and then tied above the invention 100. As another non-limiting example, the shoe 900 with no-tie fasteners such as straps using hook and loop fasteners (see FIG. 7) may be passed through the one or more attachment straps 300 and then fastened.

The one or more batteries 410 may provide electrical energy to operate the invention 100. The one or more batteries 410 may be replaceable or rechargeable. Access to the one or more batteries 410 for replacement may be provided via a battery access door (not illustrated in the figures).

The on/off control 440 may be an electrical control accessible on the side of the housing 200. The on/off control 440 may have an 'off' position that prevents the one or more LEDs 400 from illuminating and an 'on' position which allows the one or more LEDs 400 to illuminate.

In some embodiments, the on/off control 440 may have one or more additional positions (not shown in the figures), which control some aspect of the operation of the invention 100. As a non-limiting example, one or more additional positions of the on/off control 440 may determine the particular color scheme or blink pattern that the one or more LEDs 400 display.

The invention 100 may further comprise a motion sensor 420. The motion sensor 420 may be a vibration sensor, a tilt sensor, or another motion sensing component that provides a motion output signal 425 whenever the motion sensor 420 is moved. The motion sensor 420 may be coupled to the circuit board 405. The motion output signal 425 from the motion sensor 420 may be made available to the control electronics 460. The control electronics 460 may cause the one or more LEDs 400 to illuminate if the on/off control 440 is in the 'on' position and the invention 100 is moved.

The invention 100 may further comprise a timer 415. The timer 415 may be an electrical circuit that changes a timer output signal 417 after a timed interval that is predetermined. The timer 415 may be coupled to the circuit board 405. The timer output signal 417 may be made available to the control electronics 460. The timer 415 may begin the timed interval when the one or more LEDs 400 are illuminated. The control electronics 460 may cause the one or more LEDs 400 to extinguish at the end of the timed interval established by the timer output signal 417.

In some embodiments, the motion sensor 420 and the timer 415 may work cooperatively to repeatedly illuminate and extinguish the one or more LEDs 400 if the on/off control 440 is in the 'on' position. Movement of the shoe 900 may trigger the motion sensor 420 and cause the one or more LEDs 400 to illuminate; expiration of the timed interval as determined by the timer 415 may cause the one or more LEDs 400 to extinguish.

The invention 100 may further comprise a sound transducer 480. The sound transducer 480 may cause audible sounds to be produced when activated by the application of an audio signal 485 provided by the control electronics 460. The sound transducer 480 may be coupled to the circuit board 405. The audio signal 485 may carry one or more monotonic sounds, including a sequence of tones, music, speech, or a combination thereof. In some embodiments, the control electronics 460 may activate and/or deactivate the sound transducer 480 in response to input from the timer 415 or the motion sensor 420.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may be construed to mean recharging or replacing individual cells, individual batteries of cells, or a package of multiple battery cells as is appropriate for any given battery technology that may be used.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", mean connected, either directly or indirectly and does not necessarily imply a mechanical connection.

As used herein, "front" means 1) the side of an object that is closest to a forward direction of travel under normal use of the object or 2) the side or part of an object that normally presents itself to view or that is normally used first. "Rear" or "back' is the side opposite the front.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, a "housing" is a rigid casing that encloses and protects one or more devices.

As used in this disclosure, an "LED" is an acronym for a light emitting diode. An LED allows current to flow in one direction and when current is flowing the LED emits photons in a narrow spectral range. The wavelength of the light that is emitted may be in the visible range of the spectrum or may extend into either the infrared (IR) spectral range or the ultraviolet (UV) spectral range. The brightness of the LED can be increased and decreased by controlling the amount of current flowing through the LED. Multiple LEDs having different emission spectrums may be packaged into a single device to produce a multi-color LED. A broad range of colors may be produced by multi-color LEDs by selecting which of the multiple LEDs are energized and by controlling the brightness of each of the multiple LEDs. Organic LEDs (OLEDs) are included in this definition.

As used in this disclosure, a "lens" is a transparent substance through which light can pass. A lens may or may not be formed with curved surfaces that are used to concentrate or disperse the light that travels through the lens.

As used in this disclosure, a "sensor" is a device that receives and responds in a predetermined way to a signal or stimulus.

As used in this disclosure, a "transducer" is a device that converts a physical quantity, such as pressure or brightness into an electrical signal or a device that converts an electrical signal into a physical quantity.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An illuminating-shoe attachment comprising:

a housing, a clear lens, one or more LEDs, one or more attachment straps, one or more batteries, an on/off control, and a circuit board;

wherein the illuminating-shoe attachment attaches to laces of a shoe and provides illumination at the front of the shoe;

wherein the illumination improves visibility at night, is decorative, or both;

wherein the housing is an enclosure for the one or more LEDs, the one or more attachment straps, the one or more batteries, the on/off control, the circuit board, and the clear lens;

wherein the housing has a top and a bottom with the top being the surface facing away from the shoe and the bottom being the surface facing towards the shoe;

wherein the housing is a plastic enclosure that is circular when seen from the top and that has a uniform thickness when viewed from any side;

wherein the clear lens is coupled to the top of the housing;

wherein the clear lens allows the illumination from the one or more LEDs to exit the housing while protecting the illuminating-shoe attachment from water exposure;

wherein the one or more LEDs are located under the clear lens on an inset surface under the clear lens;

wherein the one or more LEDs are light sources;

a motion sensor;

wherein the motion sensor is a motion sensing component that provides a motion output signal whenever the motion sensor is moved;

wherein the motion sensor is coupled to the circuit board;

wherein the motion output signal from the motion sensor is made available to the control electronics;

wherein the control electronics cause the one or more LEDs to illuminate if the on/off control is in the 'on' position and the illuminating-shoe attachment is moved;

a timer;

wherein the timer is an electrical circuit that changes a timer output signal after a predetermined timed interval has elapsed;

wherein the timer is coupled to the circuit board;

wherein the timer output signal is made available to the control electronics;

wherein the timer begins the predetermined timed interval when the one or more LEDs are illuminated;

wherein the control electronics cause the one or more LEDs to extinguish at the end of the predetermined timed interval established by the timer output signal;

a sound transducer;

wherein the sound transducer produces audible sounds when activated by the application of an audio signal provided by the control electronics;

wherein the sound transducer is coupled to the circuit board;

wherein the audio signal carries one or more monotonic sounds including a sequence of tones, music, speech, or a combination thereof;

wherein the motion sensor and the timer work cooperatively to repeatedly illuminate and extinguish the one or more LEDs if the on/off control is in the 'on' position;

wherein movement of the shoe triggers the motion sensor and causes the one or more LEDs to illuminate; expiration of the predetermined timed interval as determined by the timer causes the one or more LEDs to extinguish.

2. The illuminating-shoe attachment according to claim 1 wherein the inset surface is the circuit board upon which the one or more LEDs are mounted.

3. The illuminating-shoe attachment according to claim 1 wherein the one or more LEDs are all the same color, are a mixture of different colors, or are multi-color LEDs.

4. The illuminating-shoe attachment according to claim 1 wherein the illuminating-shoe attachment comprises control electronics which change the brightness and/or color of the one or more LEDs in a random pattern or in a predetermined pattern;

wherein the control electronics are coupled to the circuit board.

5. The illuminating-shoe attachment according to claim 4 wherein the one or more attachment straps are coupled to the bottom of the housing;

wherein the one or more attachment straps provide a physical interface for attaching the illuminating-shoe attachment to the shoe;

wherein the laces of the shoe are passed through the one or more attachment straps to removably couple the illuminating-shoe attachment to the shoe.

6. The illuminating-shoe attachment according to claim 4 wherein hook and loop strips are used to secure the housing to the shoe.

7. The illuminating-shoe attachment according to claim 4 wherein the one or more batteries provide electrical energy to operate the illuminating-shoe attachment;

wherein the one or more batteries are replaceable or rechargeable;

wherein access to the one or more batteries for replacement is provided via a battery access door.

8. The illuminating-shoe attachment according to claim 7 wherein the on/off control is an electrical control accessible on the side of the housing;

wherein the on/off control has an 'off' position that prevents the one or more LEDs from illuminating and an 'on' position which allows the one or more LEDs to illuminate.

9. The illuminating-shoe attachment according to claim 8 wherein the one or more additional positions of the on/off control determine the particular color scheme or blink pattern of the one or more LEDs display.

10. The illuminating-shoe attachment according to claim 9 wherein the control electronics activate and/or deactivate the sound transducer in response to input from the timer or the motion sensor.

* * * * *